US005235842A

United States Patent [19]

Freeman et al.

[11] Patent Number: 5,235,842

[45] Date of Patent: Aug. 17, 1993

[54] DIE ALIGNMENT SYSTEM FOR CRANK AND SLIDE PRESS

[75] Inventors: Gordon L. Freeman; Michael D. Miles, both of Findlay, Ohio

[73] Assignee: Ball Corporation, Muncie, Ind.

[21] Appl. No.: 928,398

[22] Filed: Aug. 12, 1992

[51] Int. Cl.[5] ..... B21D 22/28

[52] U.S. Cl. ..... 72/467; 33/644; 72/349

[58] Field of Search ..... 33/641, 644, 645, 661, 33/627; 72/347, 349, 467

[56] References Cited

U.S. PATENT DOCUMENTS

| | | | |
|---|---|---|---|
| 2,779,040 | 1/1957 | Scarff | 33/644 |
| 3,555,865 | 1/1971 | Sebastian . | |
| 3,744,293 | 7/1973 | Miller | 72/467 |
| 4,190,961 | 3/1980 | James et al. | 33/644 |
| 4,563,824 | 1/1986 | Baun | 33/644 |
| 5,052,121 | 10/1991 | Wachtler . | |
| 5,129,252 | 7/1992 | Hahn et al. | 72/467 |

*Primary Examiner*—Lowell A. Larson

*Attorney, Agent, or Firm*—Gilbert E. Alberding

[57] ABSTRACT

Die alignment apparatus for aligning redraw and ironing dies in die slots of a tool pack of a crank and slide press includes an alignment die and a calibration fixture. The alignment die includes a die body and a pair of position transducers disposed in the die body along separate ones of transducer axes. The calibration fixture locates the alignment die by a pair of locator pins that engage an outer cylindrical surface of the alignment die; and the transducers are calibrated by contact with a calibration punch that is a part of the calibration fixture. In use, the alignment die and an alignment punch replace the production punch and the redraw and ironing dies. The alignment die is placed in one die slot of the tool pack, and the alignment die is positioned along X and Y axes by adjusting wedges that are moved by rotationally positioning adjusting sleeves until the readout device indicates accurate alignment of the alignment die with the alignment punch, and the alignment die and the alignment punch are replaced by a production die and a production punch.

25 Claims, 4 Drawing Sheets

DIE ALIGNMENT SYSTEM FOR CRANK AND SLIDE PRESS

BACKGROUND OF THE INVENTION

1. Field of the Invention

The present invention relates generally to crank and slide presses for manufacturing metal containers. More particularly, the present invention relates to apparatus and method for aligning the redraw die and the ironing dies with a redraw punch that is attached to a body maker ram.

2. Description of the Related Art

Crank and slide presses are used for punching, shearing, drawing, and redrawing operations in manufacturing articles from metallic sheets or rolls of metallic strip material. In general, a crank and slide press includes a crank that is mounted for rotary motion, an electric motor that is connected to the crank that imparts rotary motion thereto, a connecting rod that is attached to the crank, and mechanism for changing motion from the connecting rod to rectilinear reciprocating motion. A more detailed description of crank and slide presses is given by Maytag in U.S. Pat. No. 3,696,657, issued Oct. 10, 1972.

One specific use for a crank and slide press is in the production of beverage cans. A redraw cup is drawn from a coiled strip by a first crank and slide press, and then the redraw cup is redrawn on a second crank and slide press forcing the redraw cup through a tool pack subassembly that includes a redraw die and a plurality of ironing dies.

In the highly competitive container industry, a container must be made with the absolute minimum of material, which means that the finished container must have extremely thin walls. It should be apparent that the use of extremely thin walls of the finished containers places stringent concentricity requirements on the walls of the container, and thereby on concentricity of the redraw die and ironing dies with the redraw punch.

More particularly, it is highly desirable to maintain concentricity of the redraw die and ironing dies to the redraw punch, to less than 0.0003 inches (0.00762 mm); and it is imperative that maximum wall thickness variations be kept to less than 0.001 inches (0.0254 mm).

Further, because of the competitiveness of the container industry, the speed of the press must be maximized and downtime of the press must be minimized. As should be apparent, maximizing speed and minimizing downtime are inherently opposite, because higher speeds impose higher stresses on the machinery and cause higher wear rates.

In the redraw operation, a tool pack subassembly, with the redraw die and a plurality of ironing dies therein, is mounted circumferentially around the longitudinal machine axis wherein the body maker ram is reciprocated; a redraw punch is attached to the body maker ram and is reciprocated towards, into, and through the tool pack subassembly, including both the redraw die and the ironing dies thereof; and the redraw punch is withdrawn from the tool pack subassembly and all of the parts thereof.

A redraw cup is positioned against the redraw die and is resiliently held against the redraw die by a redraw sleeve, the redraw sleeve is attached to a redraw carriage, and the redraw carriage is reciprocated toward and away from the redraw die.

The redraw sleeve serves two functions. One function of the redraw sleeve is to assure concentricity between the redraw cup and the redraw die. The other function of the redraw sleeve is to provide resilient clamping between a clamping face of the redraw sleeve, the redraw cup, and the redraw die, thereby preventing wrinkling of the metal as the redraw cup is redrawn through the redraw die.

Because of stringent alignment requirements, the redraw die must be aligned with the redraw punch, and then each of the ironing dies must be separately aligned with the redraw punch.

In a typical tool pack subassembly, each of the dies in the tool pack are positioned by two wedges each which provides adjustment along one of two transverse and intersecting axes, and by an air cylinder that resiliently forces that die against the aforementioned adjusting wedges. Each of the wedges is selectively positioned by loosening two locknuts, turning an adjusting screw, and locking the two locknuts.

In the prior art, a die alignment system has been used in which four magnetic position transducers, two along each of two transverse and intersecting axes, have been used. Each transducer senses the relative distance to the redraw punch, and so the readout of the transducers must be balanced to provide a readout that indicates eccentricity of a given die to the redraw punch.

In contrast to the prior art, the present invention provides die alignment and method in which two mechanical-contact transducers, one for each of two transverse and intersecting axes, are used, and in which the transducers are precalibrated on a calibrating fixture, thereby providing an absolute, rather than a relative, readout.

In a first aspect of the present invention, a method is provided for aligning a body maker die with a redraw punch in a crank and slide press having a body maker ram adapted for attachment of the redraw punch thereto and having a tool pack with a plurality of die slots therein, which method includes disposing first and second position transducers in an alignment die along respective ones of first and second transducer axes that are orthogonal to each other and to a longitudinal reference axis; calibrating the readout of the transducers with respect to first and second calibration dimensions; placing the alignment die in the tool pack with the longitudinal reference axis parallel to a longitudinal machine axis of the body maker ram; attaching an alignment punch to the body maker ram; inserting the alignment punch into the alignment die; taking measurements along the first and second transducer axes; and positioning the alignment die along X and Y axes that are orthogonal to each other and to the longitudinal machine axis.

In a second aspect of the present invention, a method is provided for aligning a body maker die with a redraw punch in a crank and slide press having a body maker ram adapted for attachment of the redraw punch thereto and having a tool pack with a plurality of die slots therein, which method includes disposing a first position transducer and a second position transducer in an alignment die; placing the alignment die into a calibration fixture with a calibration surface; calibrating the first and second position transducers against the calibration surface; inserting the alignment die in one of the die slots of the tool pack; and positioning the alignment die along X and Y axes.

In a third aspect of the present invention, a method is provided for aligning a body maker die with a redraw punch in a crank and slide press having a body maker ram adapted for attachment of a redraw punch thereto and having a tool pack with a plurality of die slots therein, which method includes disposing first and second position transducers along first and second transducer axes in an alignment die; disposing the alignment die around a calibration surface; radially positioning the alignment die by contacting a locating surface thereof that is disposed radially outward of the alignment die; zeroing the readout of the transducers with respect to the calibration surface; disposing the alignment die in one of the die slots; positioning the alignment die by contact with the locating surface thereof; and positioning the alignment die along X and Y axes in accordance with the calibrating step.

In a fourth aspect of the present invention, a die alignment apparatus is provided for aligning a body maker die with a redraw punch in a crank and slide press having a body maker ram adapted for attachment of the redraw punch thereto and having a tool pack with a plurality of die slots therein, which alignment apparatus includes a base having a surface; a calibration punch being disposed around a longitudinal calibration axis that is orthogonal to the surface of the base, being attached to the base, and having a calibration surface that extends orthogonally from the surface of the base; an alignment die having an outer surface, and having an opening therethrough that is removably disposed over the calibration punch; locator means, comprising spaced-apart locator pins that are attached to the base, for locating the alignment die by contact with the outer surface; and transducer means, comprising first and second position transducers that are operatively attached to the alignment die, for taking measurements with respect to the calibration surface.

In a fifth aspect of the present invention, a die alignment apparatus is provided for aligning a body maker die with a redraw punch in a crank and slide press having a body maker ram adapted for attachment of the redraw punch thereto and having a tool pack with a plurality of die slots therein, which alignment apparatus includes an alignment die having inner and outer surfaces that are disposed circumferentially around a longitudinal reference axis, and having first and second position transducers that are disposed along respective ones of first and second transducer axes that are orthogonal to the longitudinal reference axis and to each other; and a calibration fixture having locator means for locating the alignment die by contact with the outer surface of the alignment die, and having calibration surface means for calibrating the position transducers.

SUMMARY OF THE INVENTION

Die alignment apparatus and method are provided for aligning a redraw die and a plurality of ironing dies with a redraw punch in a crank and slide press having a body maker ram adapted for attachment of the redraw punch thereto, and having a tool pack with a plurality of die slots therein for receiving the redraw die and the ironing dies.

The die alignment apparatus includes an alignment die and a calibration fixture. The alignment die includes a die ring having inner and outer cylindrical surfaces that are disposed concentrically around a longitudinal reference axis, and first and second position transducers that are disposed orthogonally to each other and to the longitudinal reference axis.

The calibration fixture includes a base, a calibration punch with both a longitudinal calibration axis and a cylindrical calibration surface that are disposed orthogonal to the base, first and second spaced-apart locator pins that are disposed radially outward from the cylindrical calibration surface, and a locating latch.

The method of the present invention includes placing the alignment die on the calibration fixture with the inside cylindrical surface surrounding the calibration punch, using the locating latch to urge the alignment die radially against the locator pins, calibrating the position transducers with respect to the cylindrical calibration surface, and using the alignment die to successively align each of the dies in the tool pack. Optionally, the method includes rotating the alignment die, repeating the calibrating step, repositioning one or both of the locator pins, and again repeating the calibrating step.

DESCRIPTION OF THE PREFERRED EMBODIMENTS

Figure 1:
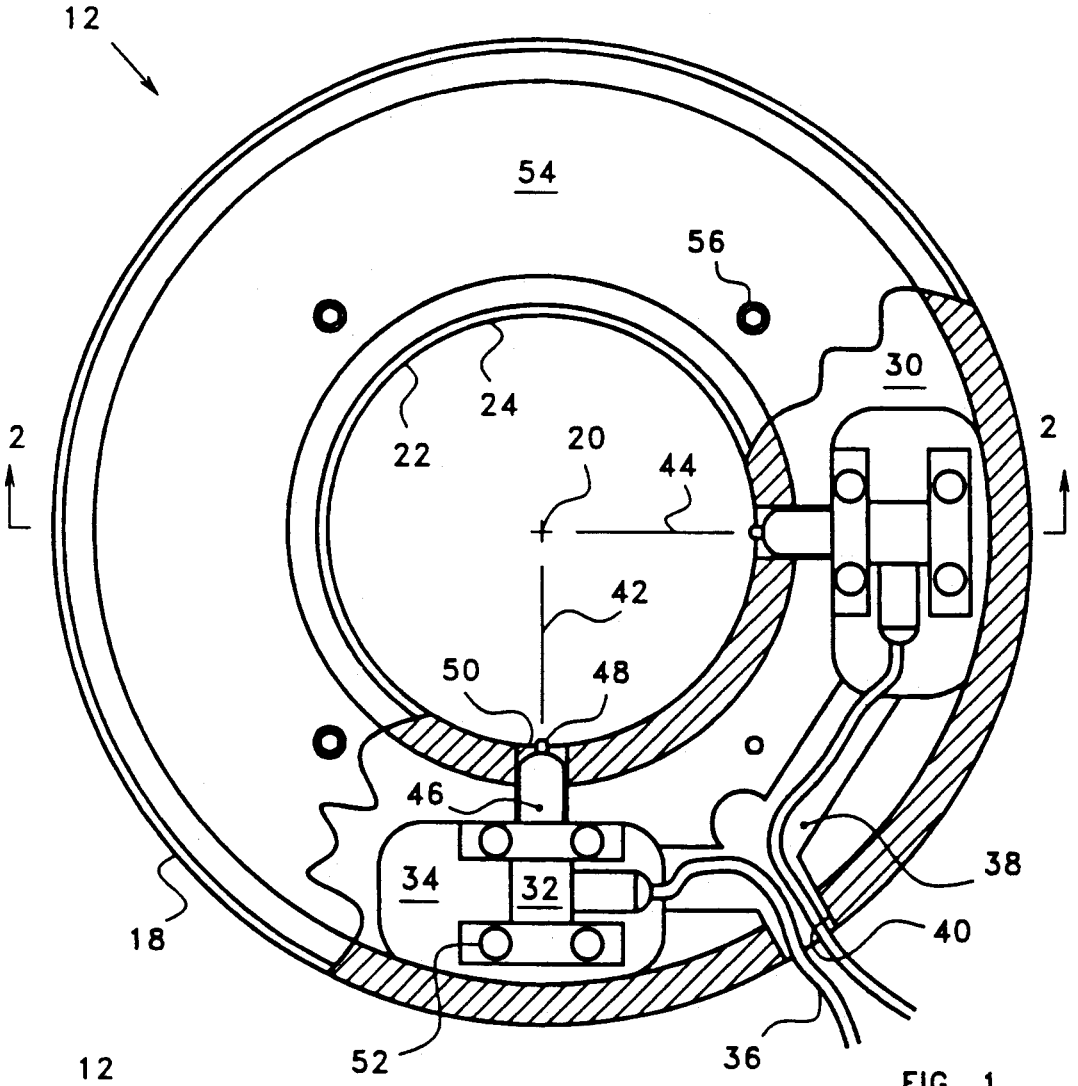
FIG. 1 is an end view of the alignment die of the present invention with a portion cut away to show the position transducers thereof.
Figure 2:
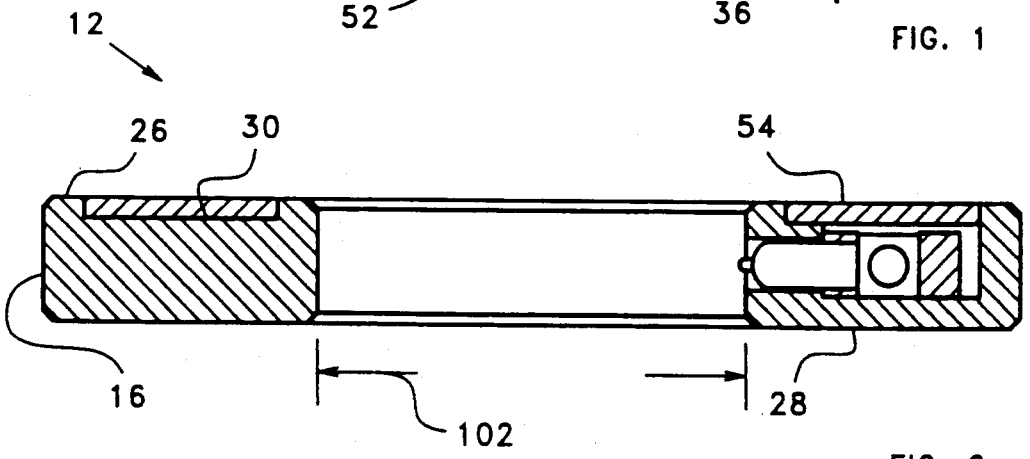
FIG. 2 is a cross sectional view of the alignment die of FIG. 1, taken substantially as shown by section line 2—2 of FIG. 1.
Figure 3:
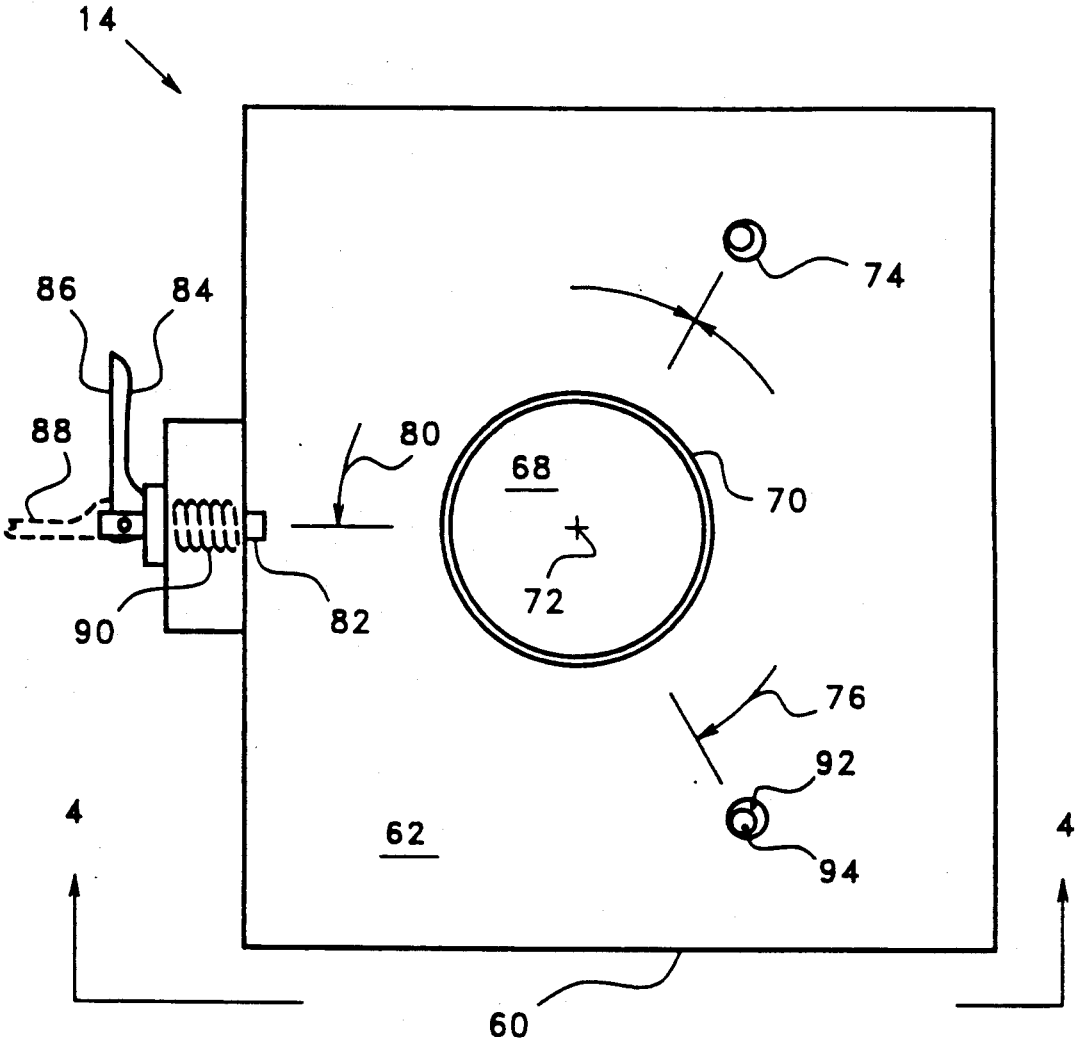
FIG. 3 is a top view of the calibration fixture of the present invention.
Figure 4:
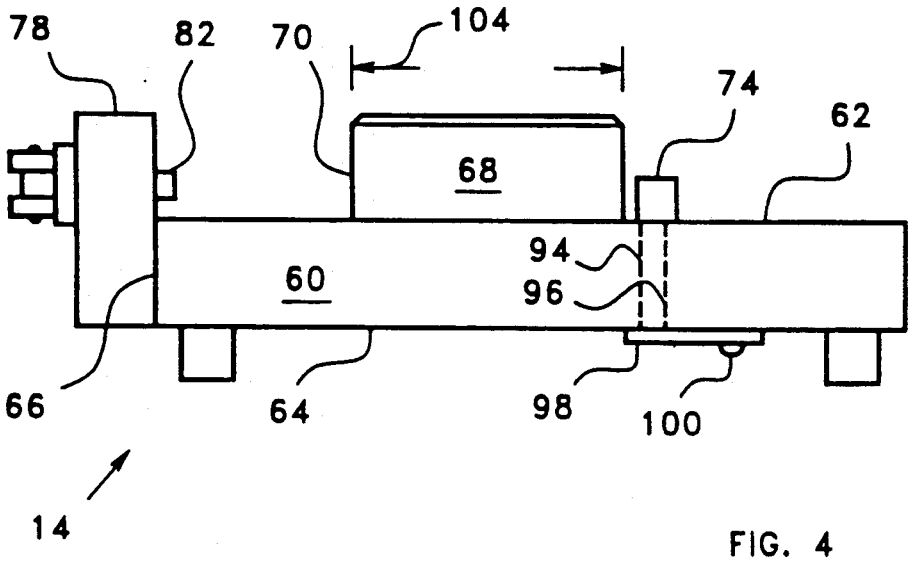
FIG. 4 is a side view of the calibration fixture of FIG. 3 taken substantially as shown by view line 4—4 of FIG. 3.
Figure 5:
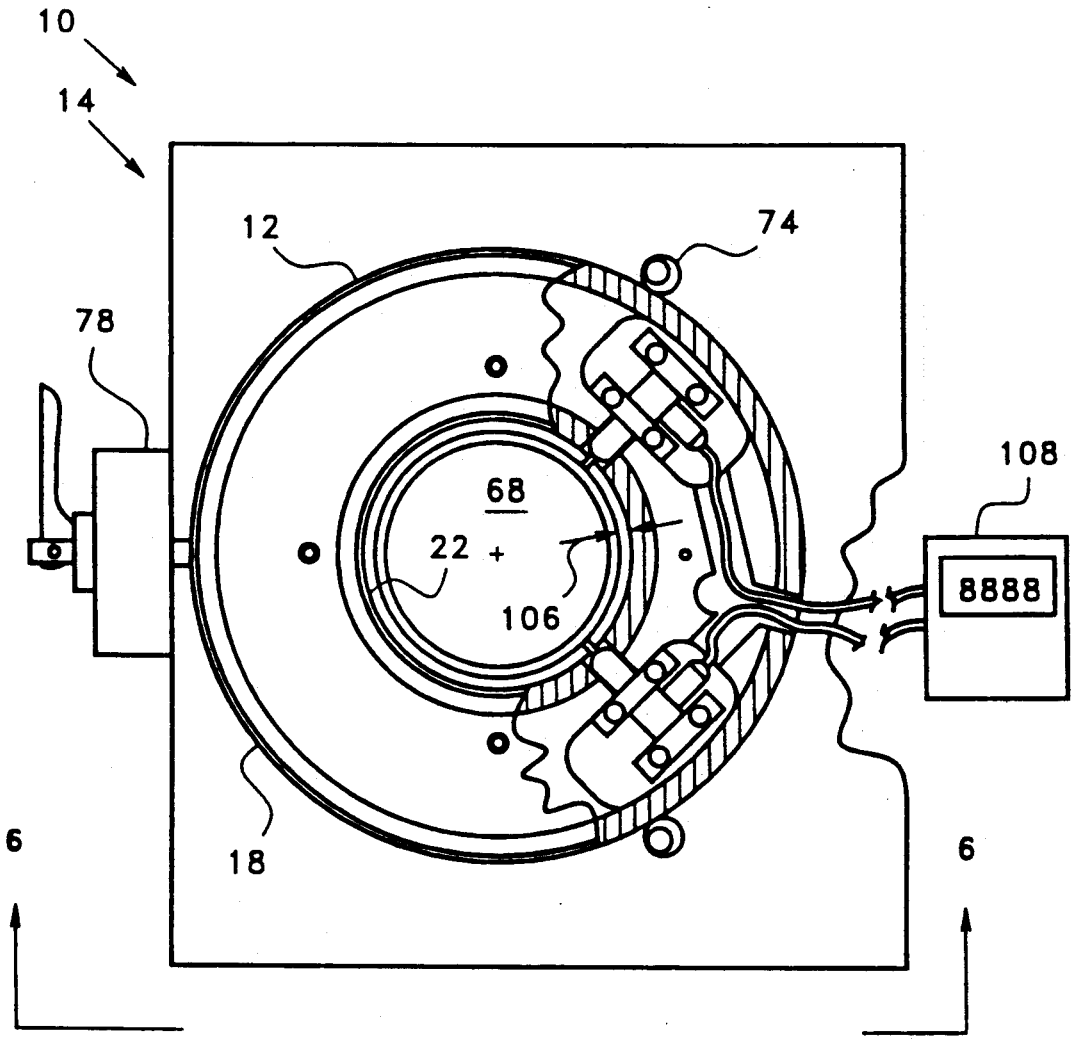
FIG. 5 is a top view of the calibration fixture of FIGS. 3 and 4, taken substantially as shown in FIG. 3, with the alignment die of FIGS. 1 and 2 installed thereon.
Figure 6:
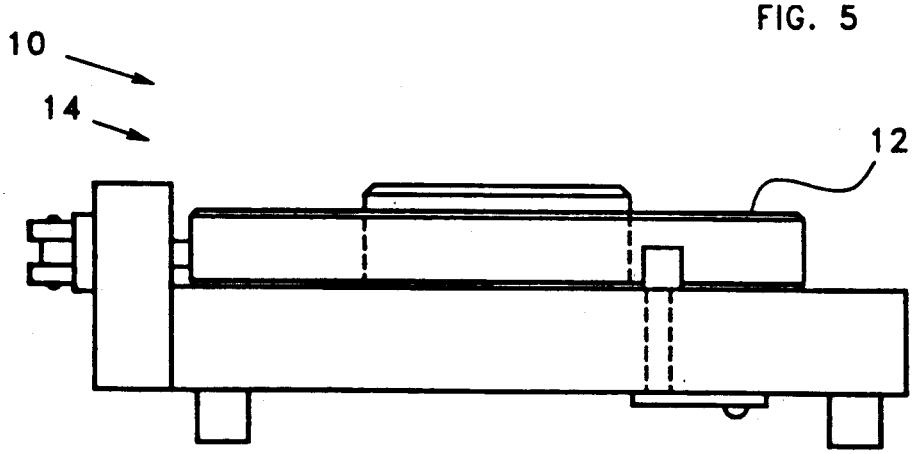
FIG. 6 is a side view of the calibration fixture of FIGS. 3 and 4, taken substantially as shown in FIG. 4, with the alignment die of FIGS. 1 and 2 installed thereon.

Referring now to FIGS. 1–6, the die alignment apparatus 10 of FIGS. 5 and 6 includes an alignment die 12 of FIGS. 1 and 2 and a calibration fixture 14 of FIGS. 3 and 4.

Referring now to FIGS. 1 and 2, the alignment die 12 includes a die body 16 with an outer cylindrical surface, or locating surface, 18 that is disposed circumferentially around a longitudinal reference axis 20, a bore, or opening, 22 with an inner cylindrical surface 24, a planar face 26, an opposite face 28, and a circumferential recess 30. A pair of position transducers 32 are disposed in respective ones of recess pockets 34, and electrical cables 36 exit the die body 16 via recess passages 38 and a transverse opening 40 in the die body 16.

The position transducer 32 is disposed along a first transducer axis 42 and the position transducer 32 is disposed along a second transducer axis 44. The first and second axes, 42 and 44, and the position transducers 32 are disposed orthogonally to each other and to the longitudinal reference axis 20. Each of the position transducers 32 includes a neck 46 and a measuring prod 48 that extend through respective ones of radial holes 50 in the die body 16, and both of the position transducers 32 are attached to the die body 16 by machine screws 52. Finally, a cover plate 54 is disposed in the circumferential recess 30 and is attached to the die body 16 by machine screws 56.

Referring now to FIGS. 3 and 4, the calibration fixture 14 includes a base 60 with a top surface 62, a bottom surface 64, and an edge 66. A calibration punch 68 having a cylindrical calibration surface 70 is attached to the base 60 with a longitudinal calibration axis 72 being orthogonal to the top surface 62 of the base 60.

A pair of spaced-apart locator pins, or spaced-apart locating stops, 74 are located radially outward from the longitudinal calibration axis 72, and serve as locator means for locating the alignment die 12 of FIGS. 1 and 2 substantially concentric with the cylindrical calibration surface 70 and longitudinal calibration axis 72 by contacting the outer cylindrical surface 18 of the alignment die 12 of FIGS. 1 and 2. The locator pins 74 are spaced apart by an angle 76 which is preferably 120 degrees.

A positioning device 78 is attached to the edge 66 of the base 60. The positioning device 78 is disposed at an angle 80 from each of the locator pins 74, and the angle 80 is preferably 120 degrees. The positioning device 78 includes a plunger 82 and a handle 84. The handle 84 is movable from a released position 86, as shown, to an engaged position 88 which is shown in phantom lines. A spring 90 resiliently urges the plunger 82 toward the longitudinal calibration axis 72, so that the spring 90 and the plunger 82 provide means for resiliently urging the alignment die 12 of FIGS. 1 and 2 toward and against the locator pins 74.

Any commercially available positioning device, such as the positioning device 78, or any other suitable device, with or without spring loading as described, may be used as a means for positioning the alignment die 12 against the locator pins 74. However, since excessive force exerted by the plunger 82 could elastically distort the outer cylindrical surface 18 of the alignment die 12 by a measurable amount, spring loading of the plunger 82 is preferable.

The locator pins 74 each include a cylindrically-shaped contact portion 92 and a cylindrically-shaped attaching portion 94 with the contact and attaching portions, 92 and 94, being eccentric, one to the other, as shown. The attaching portions 94 are disposed in bores 96 in the base 60, and a lever, or positioning arm, 98 is attached to each one of the attaching portions 94. Since the contact portions 92 and the attaching portions 94 are eccentric, rotational positioning of the locator pins 74 results in the contact portions 92 moving radially closer to, or farther away from, the cylindrical calibration surface 70 and the longitudinal calibration axis 72 thereof.

The positioning arm 98, which is attached to each of the attaching portions 94 of the locator pins 74, provides means for rotationally positioning the locator pins 74, and cooperates with the eccentricity of the portions 92 and 94 to provide means for radially positioning the contact portions 92 with respect to the cylindrical calibration surface 70 and the longitudinal calibration axis 72. Subsequent to radial positioning of respective ones of the locator pins 74 by respective ones of the arms 98, respective ones of cap screws 100 cooperate with one of the arms 98 to provide means for locking respective ones of the locator pins 74 at a precise distance from the cylindrical calibration surface 70.

Referring now to FIGS. 1–6, and more particularly to FIGS. 5 and 6, the alignment die 12 of FIGS. 1 and 2 is shown placed in the calibration fixture 14 with the calibration punch 68 of the calibration fixture 14 inserted into the bore 22 of the alignment die 12, and with the outer cylindrical surface 18 of the alignment die 12 resiliently pressed against the locator pins 74 by the positioning device 78.

As shown in FIGS. 1 and 2, the bore 22 of the alignment die 12 has a diameter 102, and as shown in FIGS. 3 and 4, the calibration punch 68 has a diameter 104. The diameter 102 is larger than the diameter 104 as indicated by a greatly exaggerated radial gap 106, as shown in FIG. 5. The electrical cables 36 are attached to any suitable readout device, such as a readout device 108.

Figure 8:
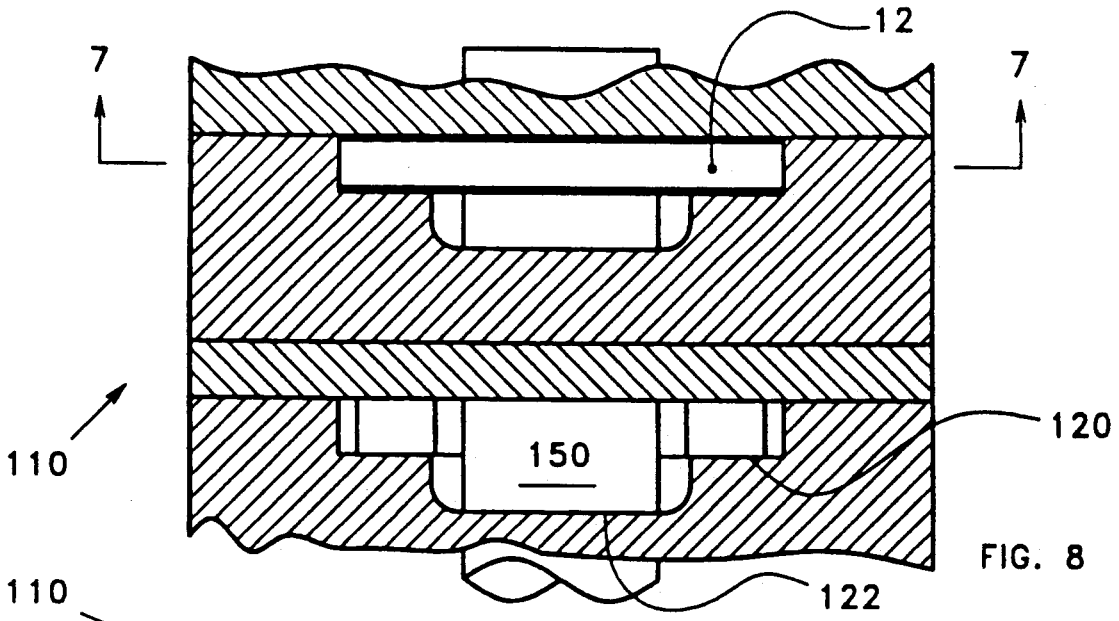
FIG. 8 is a cross section of the tool pack subassembly of FIG. 7, taken substantially as shown by section line 8—8 of FIG. 7, with the alignment die of the present invention inserted in one of the die slots.
Figure 7:
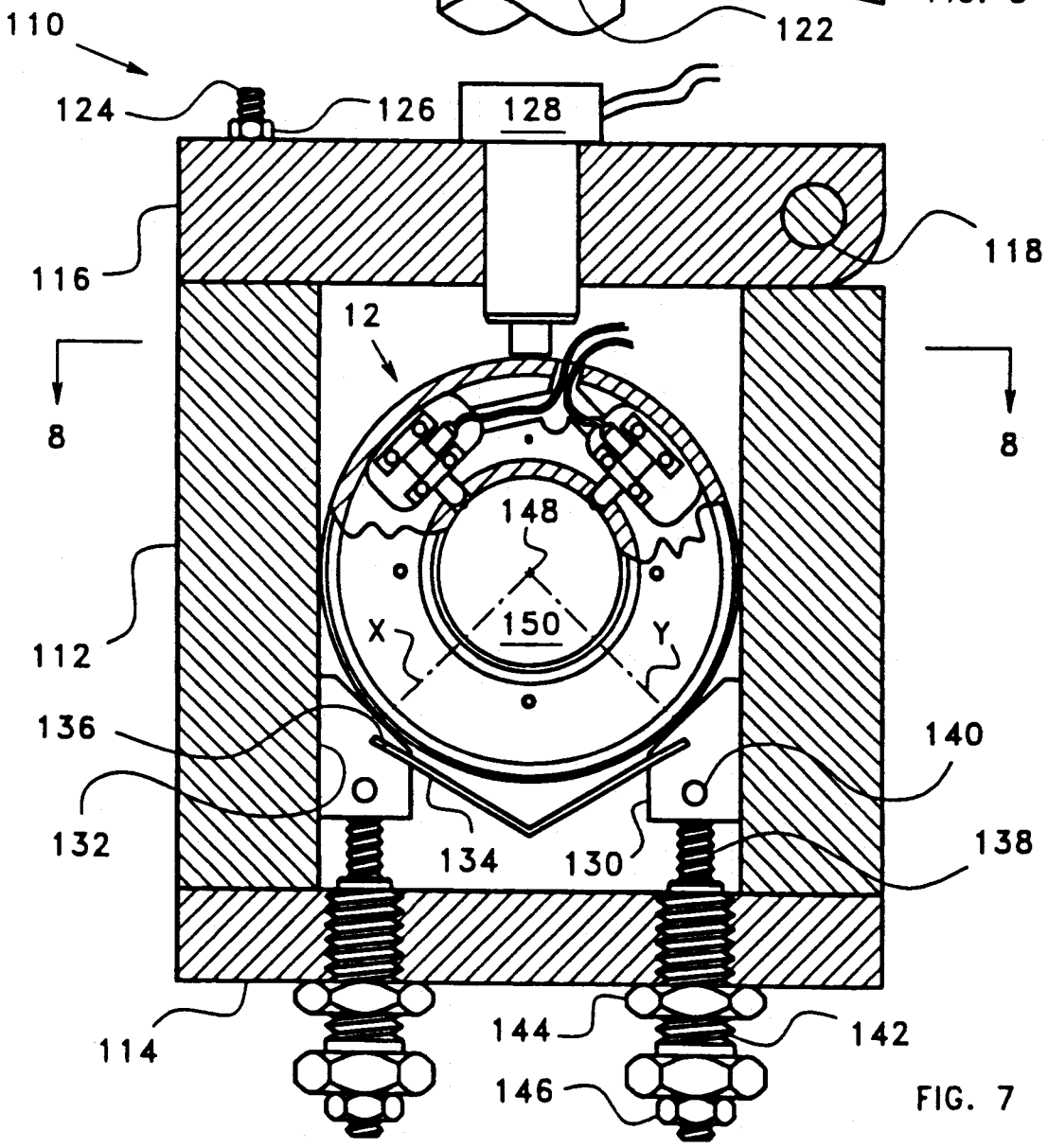
FIG. 7 is a cross sectional elevation of a tool pack subassembly as commonly used on crank and slide presses, taken substantially as shown by section line 7—7 of FIG. 8, and with the alignment die of the present invention inserted into one of the die slots.

Referring now to FIGS. 7 and 8, a tool pack 110, of conventional design, includes a body 112, a bottom 114, a lid 116 that is pivotally attached to the body 112 by a pin 118 and a similar pin, not shown, die slots 120, and finger slots 122. A threaded stud 124 and a nut 126 provide means for securing the lid 116 in a closed position, as shown.

In accordance with conventional design, a body maker die consisting of either a redraw die or an ironing die, neither one shown, is placed into one of the die slots 120 of the tool pack 110, the lid 116 is closed and locked with the threaded stud 124 and the nut 126, air is applied to an air actuator 128, and the air actuator 128 resiliently presses the die, not shown, downwardly against a pair of spaced-apart adjusting wedges 130, in the same manner as can be seen with the alignment die 12 which is shown in FIGS. 7 and 8.

Further, in accordance with conventional design, the wedges 130 are resiliently pressed against wall surfaces 132 by a bent spring 134 that engages slots 136 in the wedges 130. An adjusting screw 138 is pinned to each of the wedges 130 by a pin 140, the adjusting screws 138 are threaded into differential adjusting sleeves 142, and the adjusting sleeves 142 are threaded into the bottom 114 of the tool pack 110, as shown. Finally, a locknut 144 locks each of the adjusting sleeves 142 to the bottom 114 of the tool pack 110, and a locknut 146 locks each of the adjusting screws 138 to a respective one of the adjusting sleeves 142.

Thus, in accordance with conventional design and practice, a plurality of die slots 120 are included in a tool pack 110; a redraw die, not shown, and a plurality of ironing dies, not shown, are disposed in respective ones of the die slots 120; and means, including the wedges 130, is provided for adjusting each die along X and Y axes that are orthogonally disposed to each other and to a longitudinal machine axis 148.

The method of using the present invention includes placing the alignment die 12 onto the calibration punch 68, or conversely, placing the calibration punch 68 inside the alignment die 12, urging or moving the alignment die 12 radially against the locator pins 74, and calibrating the transducers 32 with the prods 48 thereof engaging the cylindrical calibration surface 70 of the calibration punch 68.

Optionally, the method of using the present invention includes rotationally positioning the alignment die 12 on the calibration fixture 14, repositioning one or both of the locator pins 74 to place the alignment die 12 in an exactly concentric relationship with the cylindrical calibration surface 70 of the calibration punch 68, and recalibrating the transducers 32.

For calibration, the alignment die 12 is located radially in the calibration fixture 14 by contact of the outer cylindrical surface 18 with the spaced-apart locator pins 74; and for use in aligning dies, the alignment die 12 is located in the die slots 120 of the tool pack 110 by two spaced-apart adjusting wedges 130.

The method of using the present invention further includes removing the alignment die 12 from the calibration fixture 14 of FIGS. 5 and 6, placing the alignment die 12 into the die slot 120 of the tool pack 110 of FIGS. 7 and 8, attaching the readout device 108 of FIG. 5, closing and securing the lid 116 of the tool pack 110, resiliently pressing the alignment die 12 down onto the wedges 130 by supplying air to the air actuator 128, attaching an alignment punch 150 in place of a redraw punch, not shown, to a body maker ram, not shown, reciprocating the alignment punch 150 into the alignment die 12, loosening the locknuts 144 and 146, taking measurements with the transducers 32 and the readout device 108, positioning the alignment die 12 along X and Y axes to zero the readout of the readout device 108 by selectively adjusting the adjusting sleeves 142, and tightening the locknuts 144 and 146.

Preferably, the alignment die 12 is rotationally positioned in the die slots 120 to make the transducer axes 42 and 44 coincide with separate ones of the X and Y axes of the tool pack 110, so that adjustment of one of the wedges 130 is read by only one of the transducers 32. Also, preferably, the method includes cycling air to the air actuator 128 to seat the alignment die 12 firmly against the wedges 130, and to remove all slackness in the adjusting system that includes the adjusting screw 138 and the differential adjusting sleeve 142.

Preferably, the adjusting wedges 130 are positioned to leave the alignment die 12 high by a predetermined amount with respect to the alignment punch 150, to allow for the alignment die 12 moving down slightly when the locknuts 144 and 146 are tightened.

Preferably, the alignment punch 150 is made of steel, and the redraw punch, not shown, is made of carbide. Since carbide is heavier than steel, a carbide redraw punch will deflect the body maker ram, not shown, more than the alignment punch 150. Therefore, if a carbide redraw punch is used, the alignment die 12 is positioned slightly low, with respect to the alignment punch 150, to allow for greater deflection of the body maker ram by the carbide redraw punch.

Therefore, optionally, the method of the present invention includes adjusting the alignment die 12 eccentric to the alignment punch 150 to allow for both increased deflection of the body maker ram by a carbide redraw punch and tightening of the locknuts 144 and 146.

In summary, calibration in the calibration fixture 14 is done with respect to the calibration punch 68 which is located on the base 60 in relationship to the locator pins 74; and alignment in the tool pack 110 is done with respect to the alignment punch 150, as shown in FIGS. 7 and 8, that replaces the redraw punch, not shown, and that is attached to the body maker ram, not shown, not a part of the present invention. Therefore, positioning of the alignment die 12 and calibration of the transducers 32, and use of the alignment die 12 in the tool pack 110 is done in the manner that most accurately represents alignment of the dies, not shown, in the tool pack 110.

For purposes of understanding the claims, it is important to realize that the alignment die 12 does not require the use of two position transducers 32. The use of two transducers 32 enhances the performance and speed of the alignment process by providing two calibration dimensions that exactly relate to the orthogonal X and Y axes of the tool pack 110 and the adjusting wedges 130 of the tool pack 110. The calibration process also benefits from the use of two calibration dimensions by exposing any eccentricity between the calibration punch 68 and the alignment die 12, realizing that the calibration surface 70 may not be concentric with the alignment die 12.

The apparatus and methods of the present invention can be clearly understood by the foregoing description, the drawings, the aspects of the invention, and the appended claims.

While specific methods and apparatus have been disclosed in the preceding description, it should be understood that these specifics have been given for purposes of disclosing the principles of the present invention and that many variations thereof will become apparent to those who are versed in the art. Therefore, the scope of the present invention is to be determined by the appended claims.

Industrial Applicability

The present invention is applicable to crank and slide presses for manufacturing metal articles, such as beverage containers, having extremely thin drawn and ironed walls.

What is claimed is:

1. A method for aligning a body maker die with a redraw punch in a crank and slide press having a body maker ram adapted for attachment of said redraw punch thereto and having a tool pack with a plurality of die slots therein, which method comprises:

a) disposing first and second position transducers in an alignment die along respective ones of first and second transducer axes that are orthogonal to each other and to a longitudinal reference axis;

b) calibrating the readout of said transducers with respect to first and second calibration dimensions;

c) placing said alignment die in said tool pack with said longitudinal reference axis parallel to a longitudinal machine axis of said body maker ram;

d) attaching an alignment punch to said body maker ram;

e) inserting said alignment punch into said alignment die;

f) taking measurements along said first and second transducer axes; and g) positioning said alignment die along X and Y axes that are orthogonal to each other and to said longitudinal machine axis.

2. A method as claimed in claim 1 in which said calibrating step comprises placing said alignment die over a calibration punch having said first and second calibration dimensions.

3. A method as claimed in claim 1 in which said calibrating step comprises:

a) placing said alignment die over a calibration punch having a calibration surface with said first and second calibration dimensions; and b) physically contacting said calibration surface with said transducers.

4. A method as claimed in claim 1 in which said calibrating step comprises:

a) positioning said alignment die with respect to a surface of said alignment die that is disposed radially outward of said transducers, and that is disposed with respect to said first and second calibration dimensions; and b) calibrating said transducers.

5. A method as claimed in claim 1 in which said calibrating step comprises:

a) placing said alignment die over a calibration punch having said first and second calibration dimensions; and b) locating said alignment die against stops that are disposed radially outward from said calibration punch.

6. A method as claimed in claim 1 in which said calibrating step comprises:

a) locating said alignment die radially against locating stops that are disposed radially outward from said transducers;

b) rotating said alignment die;

c) repeating said calibrating step; and d) adjusting the radial position of one of said stops to make the readout of one of said transducers substantially constant before and after said rotating step.

7. A method as claimed in claim 1 in which said calibrating step comprises:

a) placing said alignment die over a calibration punch;

b) locating said alignment die radially against locating stops that are disposed radially outward from said calibration punch;

c) rotating said alignment die; and d) adjusting the radial position of one of said stops to make the readout of said transducers substantially constant before and after said rotating step.

8. A method as claimed in claim 1 in which said placing step comprises rotationally positioning said alignment die to make said transducer axes thereof in substantial alignment with said X and Y axes.

9. A method as claimed in claim 1 in which said calibrating step comprises:

a) placing said alignment die over a calibration punch;

b) locating said alignment die radially against first and second locating stops that are disposed radially outward from said calibration punch;

c) calibrating said transducers with respect to said calibration punch; and d) the first said placing step comprises rotationally positioning said alignment die to make said transducer axes thereof in substantial alignment with respective ones of said X and Y axes.

10. A method as claimed in claim 1 which method further comprises:

a) replacing said alignment die with said body maker die;

b) replacing said alignment punch with said redraw punch that is heaver than said alignment punch; and c) positioning said alignment die eccentric to said alignment punch by a predetermined measurement to allow for said heaver redraw punch deflecting said body maker ram a greater distance than said alignment punch.

11. A method as claimed in claim 1 in which said positioning step comprises loosening locknuts, turning adjusting screws, and retightening said locknuts; and said method further comprises positioning said alignment die eccentric to said alignment punch by a predetermined measurement, subsequent to said loosening step and prior to said retightening step, to allow for the lowering of said alignment die by said retightening step.

12. A method for aligning a body maker die with a redraw punch in a crank and slide press having a body maker ram adapted for attachment of said redraw punch thereto and having a tool pack with a plurality of die slots therein, which method comprises:

a) disposing a first position transducer and a second position transducer in an alignment die;

b) placing said alignment die into a calibration fixture with a calibration surface;

c) calibrating said first and second position transducers against said calibration surface;

d) inserting said alignment die in one of said die slots of said tool pack; and e) positioning said alignment die along X and Y axes.

13. A method as claimed in claim 12 in which said calibrating step comprises:

a) moving said alignment die radially against two spaced-apart locating stops;

b) rotationally repositioning said alignment die; and c) repositioning one of said locating stops with respect to said calibration surface to make the readout of one of said position transducers substantially constant before and after said rotational repositioning step.

14. A method for aligning a body maker die with a redraw punch in a crank and slide press having a body maker ram adapted for attachment of a redraw punch thereto and having a tool pack with a plurality of die slots therein, which method comprises:

a) disposing first and second position transducers along first and second transducer axes in an alignment die;

b) disposing said alignment die around a calibration surface;

c) radially positioning said alignment die by contacting a locating surface thereof that is disposed radially outward of said alignment die;

d) zeroing the readout of said transducers with respect to said calibration surface;

e) disposing said alignment die in one of said die slots;

f) positioning said alignment die by contact with said locating surface thereof; and g) positioning said alignment die along X and Y axes in accordance with said calibrating step.

15. A method as claimed in claim 14 in which said method further comprises:

a) rotationally positioning said alignment die subsequent to said zeroing step and prior to said disposing step; and b) repositioning said alignment die to regain said zeroing of said readouts.

16. Die alignment apparatus for aligning a body maker die with a redraw punch in a crank and slide press having a body maker ram adapted for attachment of said redraw punch thereto and having a tool pack with a plurality of die slots therein, which alignment apparatus comprises:

a base having a surface;

a calibration punch being disposed around a longitudinal calibration axis that is orthogonal to said surface of said base, being attached to said base, and having a calibration surface that extends orthogonally from said surface of said base;

an alignment die having an outer surface, and having an opening therethrough that is removably disposed over said calibration punch;

locator means, comprising spaced-apart locator pins that are attached to said base, for locating said alignment die by contact with said outer surface; and transducer means, comprising first and second position transducers that are operatively attached to said alignment die, for taking measurements with respect to said calibration surface.

17. Die alignment apparatus as claimed in claim 16 in which said locator means comprises first and second locator pins, and means for repositioning one of said locator pins with respect to said longitudinal calibration axis.

18. Die alignment apparatus as claimed in claim 16 in which said locator means comprises:

first and second locator pins; and means, comprising selective rotational positioning of one of said locator pins, for repositioning said one locator pin with respect to said longitudinal calibration axis.

19. Die alignment apparatus for aligning a body maker die with a redraw punch in a crank and slide press having a body maker ram adapted for attachment of said redraw punch thereto and having a tool pack with a plurality of die slots therein, which alignment apparatus comprises:

an alignment die having inner and outer surfaces that are disposed circumferentially around a longitudinal reference axis, and having first and second position transducers that are disposed along respective ones of first and second transducer axes that are orthogonal to said longitudinal reference axis and to each other; and a calibration fixture having locator means for locating said alignment die by contact with said outer surface of said alignment die, and having calibration surface means for calibrating said position transducers.

20. Die alignment apparatus as claimed in claim 19 in which said calibration surface means comprises a calibration punch having a cylindrical calibration surface.

21. Die alignment apparatus as claimed in claim 19 in which said locator means comprises first and second locator pins.

22. Die alignment apparatus as claimed in claim 19 in which said locator means comprises first and second locator pins; and said calibration fixture comprises means for pressing said alignment die against said first and second locator pins.

23. Die alignment apparatus as claimed in claim 19 in which said locator means comprises first and second locator pins; and said calibration fixture comprises means for radially repositioning one of said locator pins.

24. Die alignment apparatus as claimed in claim 19 in which said locator means comprises first and second locator pins; and said calibration fixture includes means, comprising rotationally positioning one of said locator pins, for radially repositioning said one locator pin.

25. Die alignment apparatus as claimed in claim 19 in which said calibration surface means comprises a calibration punch having a cylindrical calibration surface;

said locator means comprises first and second locator pins;

said calibration fixture comprising means for pressing said alignment die against said locator pins; and said calibration fixture includes means, comprising rotationally positioning said locator pins, for radially repositioning said locator pins.

* * * * *